United States Patent [19]

Schmelzer et al.

[11] Patent Number: 4,830,534

[45] Date of Patent: May 16, 1989

[54] DUAL AMPLITUDE VIBRATION GENERATOR FOR COMPACTION APPARATUS

[75] Inventors: Lynn A. Schmelzer; William M. Smith, both of Kewanee; Raymond S. Merritt, Geneseo, all of Ill.

[73] Assignee: Hyster Company, Portland, Oreg.

[21] Appl. No.: 111,813

[22] Filed: Oct. 21, 1987

[51] Int. Cl.[4] ..... E01C 19/28

[52] U.S. Cl. ..... 404/117; 74/87

[58] Field of Search ..... 404/103, 117, 130, 133; 74/61, 87; 172/40

[56] References Cited

U.S. PATENT DOCUMENTS

| | | | |
|---|---|---|---|
| 1,207,847 | 12/1916 | Brantingham | 74/87 |
| 2,657,582 | 11/1953 | Conkling | 74/87 |
| 2,728,614 | 12/1955 | Rink | 74/61 |
| 2,861,458 | 11/1958 | Awedissjan | 74/87 |
| 2,989,869 | 6/1961 | Hanggi | 74/61 |
| 3,606,796 | 9/1971 | Pappers | 404/117 X |
| 3,610,118 | 10/1971 | Englehard | 404/117 |
| 3,814,532 | 6/1974 | Barrett | 404/117 |
| 3,822,604 | 7/1974 | Grimmer | 74/87 |
| 3,892,496 | 7/1975 | Lebrero Martinez | 404/117 |
| 3,896,677 | 7/1975 | Larson | 74/61 |
| 4,033,193 | 7/1977 | Brander | 74/87 X |
| 4,515,027 | 5/1985 | Baier et al. | 74/87 |

*Primary Examiner*—Jerome W. Massie, IV
*Assistant Examiner*—Matthew Smith
*Attorney, Agent, or Firm*—Tim A. Long

[57] ABSTRACT

Vibration is generated by the rotation of an eccentric weight attached to a rotor shaft. A relatively high or low amplitude of vibration is produced by varying the radial position of the eccentric weight relative to the centerline of the rotor shaft. A latch, responsive to the direction of rotation of the rotor shaft, and springs control the radial movement of the eccentric weight. Rotation of the rotor shaft in one direction will cause the eccentric weight to be restrained in close proximity to the shaft, producing relatively low vibration amplitude. Rotation in the opposite direction, will cause the eccentric weight to be released; permitting the eccentric weight to move radially from the rotor shaft under the influence of centrifugal force; producing a higher amplitude of vibration. Springs automatically return the eccentric weight to the low amplitude position when the rotor shaft slows.

10 Claims, 3 Drawing Sheets

DUAL AMPLITUDE VIBRATION GENERATOR FOR COMPACTION APPARATUS

BACKGROUND OF THE INVENTION

1. Field of the Invention

This invention relates to vibration generators and, more particularly, a vibration generator adapted for use in a compaction machine and capable of producing either relatively high or low amplitude of vibration over a range of frequencies.

2. Description of the Prior Art

In the vibratory compaction of materials for roads and other engineered surfaces certain qualities of the materials to be compacted make either a relatively high or low amplitude of vibration appropriate. Other factors, such as speed of the compaction machine and desired surface finish, make a higher or lower frequency of vibration appropriate. The production of a high quality surface also requires that the vibration generator be capable of starting and stopping quickly as the travel direction of the compaction machine is changed. Further, minimizing the amplitude of vibration during starting and stopping reduces the likelihood of disturbing the compacted surface. It is, therefore, desirable that the vibration generator of a compaction machine be simple and economical to manufacture, provide for easy operator selection of the appropriate amplitude and frequency, be operable at the selected amplitude throughout the range of frequencies available and be capable of rapid starting and stopping with low power requirements.

In compaction machines an unbalanced rotor is commonly utilized as a vibration generator. The rotor comprises a shaft with one or more eccentric weights attached. The frequency of vibration is varied by altering the rotational speed of the rotor. The amplitude of vibration is determined by the mass of the eccentric weight and its eccentricity, the distance from the center of mass of the eccentric weight to the rotational centerline of the rotor shaft. The amplitude of vibration is varied by altering the effective mass or the eccentricity of the eccentric weight. Likewise, the torque and, consequently, the energy to rotate the rotor varies directly with the mass and eccentricity of the eccentric weight.

A variable amplitude vibration generator utilizing a radially movable eccentric weight is known in the prior art. Brander; U.S. Pat. No. 4,033,193; discloses a variable amplitude vibration generator having a weight mounted to the rotor shaft in such a way that it can move radially from the centerline of the rotor shaft but is urged toward the rotor shaft by a spring means. When the rotor shaft is rotated, centrifugal force acts on the movable weight causing it to displaced radially increasing the eccentricity of the movable weight and increasing the amplitude of vibration. Likewise as the shaft slows the force exerted by the spring means causes the movable weight to move toward the rotor shaft reducing the vibratory amplitude and the torque necessary to rotate the rotor shaft. While this device is relatively uncomplicated and changing the amplitude of vibration is easy; vibration amplitude is frequency dependent and operation of the vibration generator at a set amplitude throughout the range of frequencies is not possible.

In the prior art various means have been utilized to control the radial positioning of the movable weight of the vibration generator. Larson; U.S. Pat. No. 3,896,677; shows a typical mechanism. However, these mechanisms have been relatively complicated and required considerable maintenance as a result of the need to make a mechanical or hydraulic connection to the movable weight through the center of the rotating and vibrating rotor shaft.

SUMMARY OF THE INVENTION

This invention provides a dual amplitude vibration generator of simple construction, which is easily operated and capable of producing the selected higher or lower amplitude of vibration throughout the entire range of available frequencies. Further, the vibration generator automatically assumes the low amplitude setting when the rotor is slowed to minimize the energy required to start and stop the rotor and disturbance to the compacted surface. This is accomplished by providing a rotor comprising a rotor shaft with an attached eccentric weight capable of movement radially from the rotor shaft but urged toward the rotor shaft by a spring means. A latch, responsive to the direction of rotation of the rotor, restrains radial movement of the eccentric weight to produce a low amplitude setting when the rotor is rotated in one direction. Rotation of the rotor in the opposite direction releases the eccentric weight allowing centrifugal force to move the eccentric weight away from the rotor shaft to produce a high amplitude setting. When the rotor is stopped or slowed to stop, while in the high amplitude setting, the spring force returns the eccentric weight to the low amplitude position reducing the starting and stopping energy required and any disturbance of the surface being compacted.

A main object of this invention is to provide an improved vibration generator for a compaction machine. Further objects, features and advantages will be understood by persons skilled in the art when the following detailed description is reviewed in conjunction with the drawings.

BRIEF DESCRIPTION OF THE DRAWINGS

The invention is described below with reference to the accompanying drawings, where.

DETAILED DESCRIPTION OF THE PREFERRED EMBODIMENT

Figure 1:
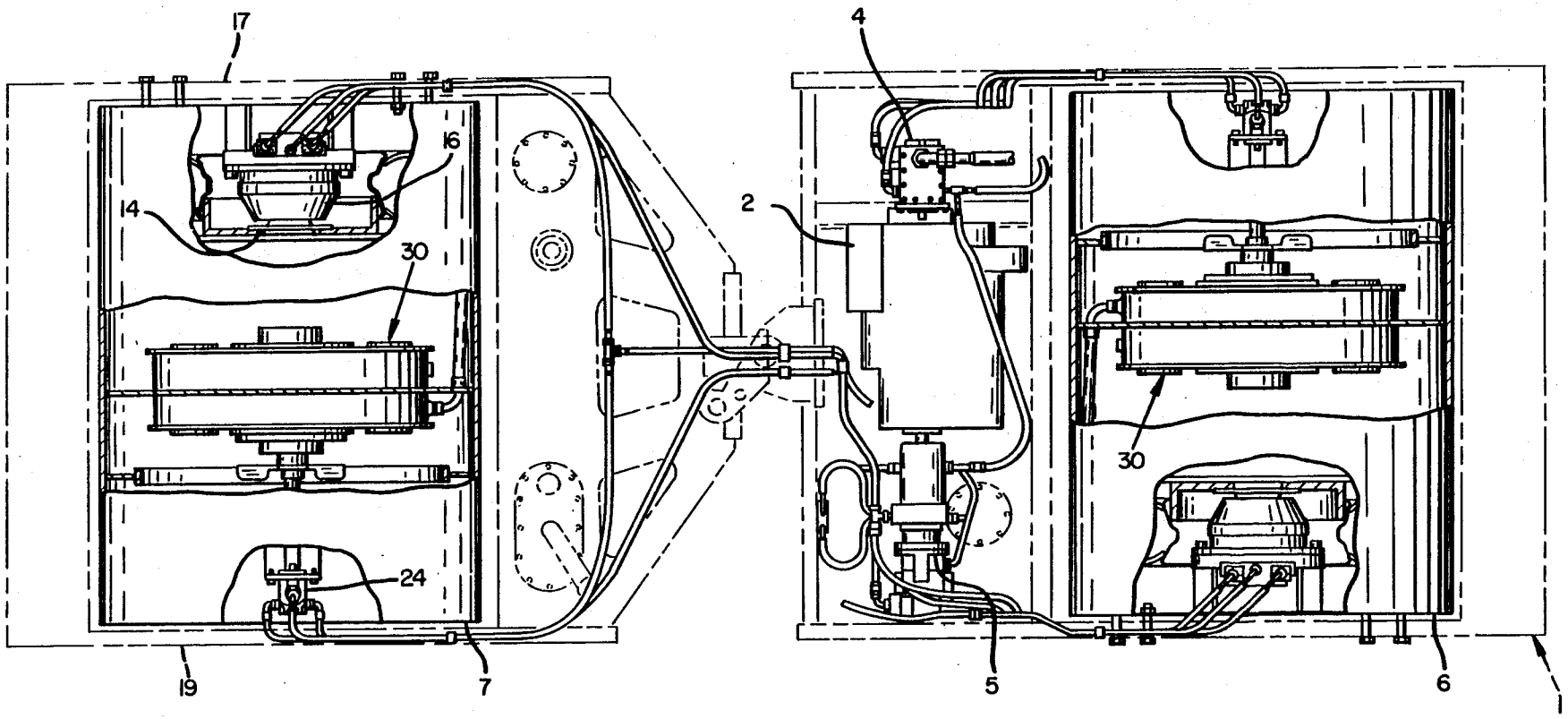
FIG. 1 shows a sectional top view of a compaction machine and its vibration generation and power system.

A typical compaction machine having a frame 1 and a power unit, comprising an internal combustion engine 2, hydraulic pumps 4 & 5, hydraulic plumbing and associated controls, is shown in FIG. 1. The frame is supported by first 6 and second 7 drums of similar construction.

Figure 2:
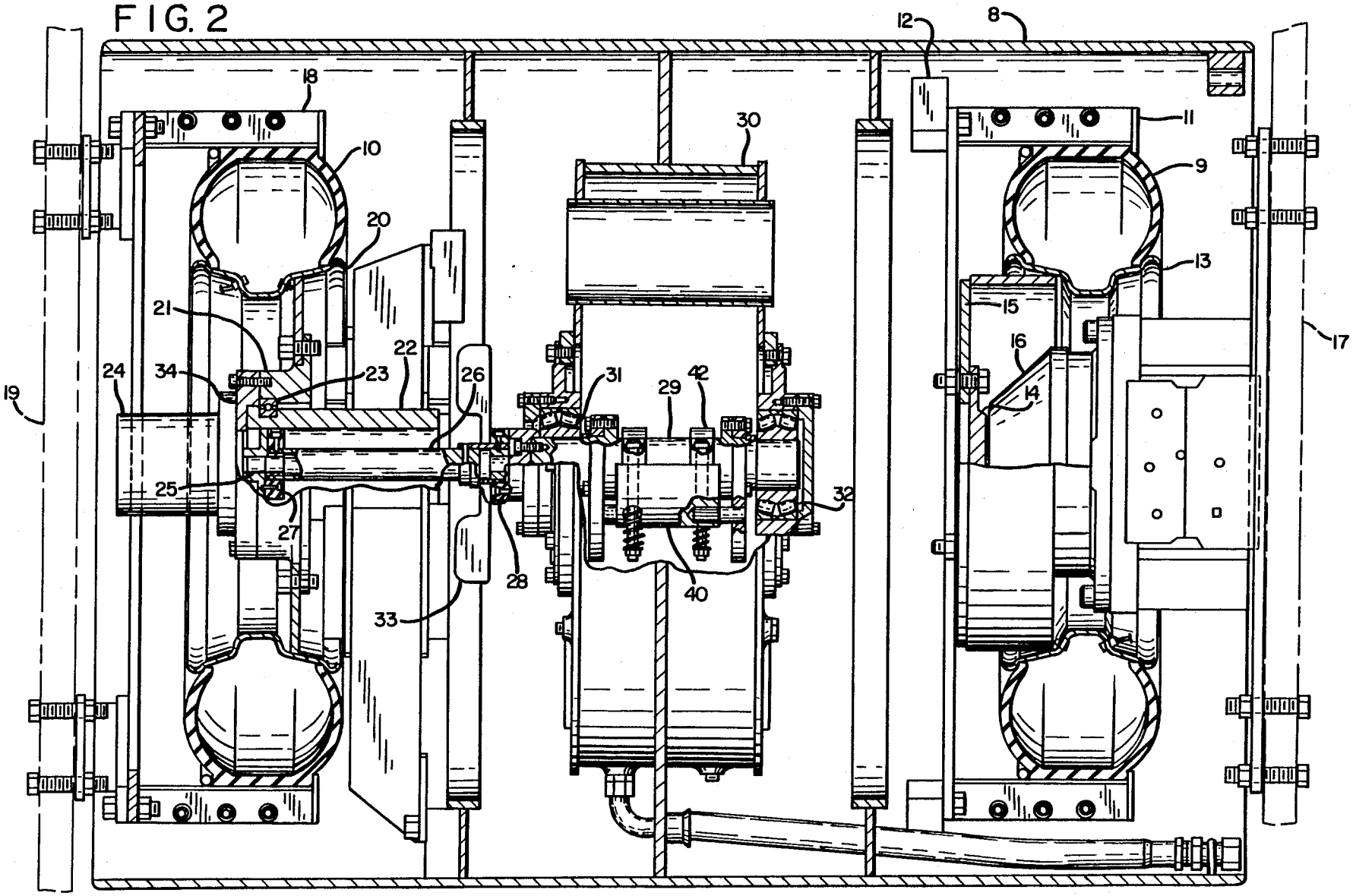
FIG. 2 is a sectional view of a drum of a compaction machine incorporating the vibration generator.

The drums 6 and 7, as illustrated in FIG. 2, comprise a shell 8 to which are attached pneumatic tire isolators 9 and 10. At one end of the drum the pneumatic tire isolator 9 is encircled by hoop 11 which is bolted to lugs 12 welded to the inner surface of the shell 8. The inner diameter of the pneumatic tire isolator 9 is mounted on a rim 13 which, in turn, is attached to the drive shaft 14 of the drum drive motor by an adaptor 15. The housing of the drum drive motor 16 is bolted to a frame plate 17. The introduction of hydraulic fluid, from the pump 5, to the drum drive motor will cause the drive shaft 14 to rotate in the housing 16. Torque is transmitted to the shell of the drum through the pneumatic tire isolator causing the drum to rotate and the compaction machine to move.

At the end of the drum opposite of the drum drive motor the outer diameter of the pneumatic tire isolator 10 is engaged by a hoop 18 which is rigidly attached to frame plate 19. The inner diameter of the pneumatic tire isolator 10 is mounted on a rim 20 to which is bolted a bearing carrier 21. An axle 22 which is rigidly attached to the drum shell is supported by bearing 23 in the bearing carrier 21. Vibration of the drum is isolated from the frame by deflection of the pneumatic tire isolators which are connected to the drum at either the inner or outer diameter and to the frame through the opposite diameter.

The housing 24 of a vibrator drive motor is bolted to the bearing carrier 21 through an adapter 34. The drive shaft 25 of the vibrator drive motor is connected by a spline to a rotor drive shaft 26 having flexible couplers 27 & 28. The rotor drive shaft 26 is connected to the rotor shaft 29 through the flexible coupler 28. The rotor shaft 29 is supported, by bearings 31 and 32, in a vibrator housing 30, which is attached to the drum shell. Cooling of the bearings 31 & 32 is provided by oil in the vibrator housing and a fan 33, driven by the vibrator drive shaft 26 which directs air around the housing to increase cooling.

Figure 3:
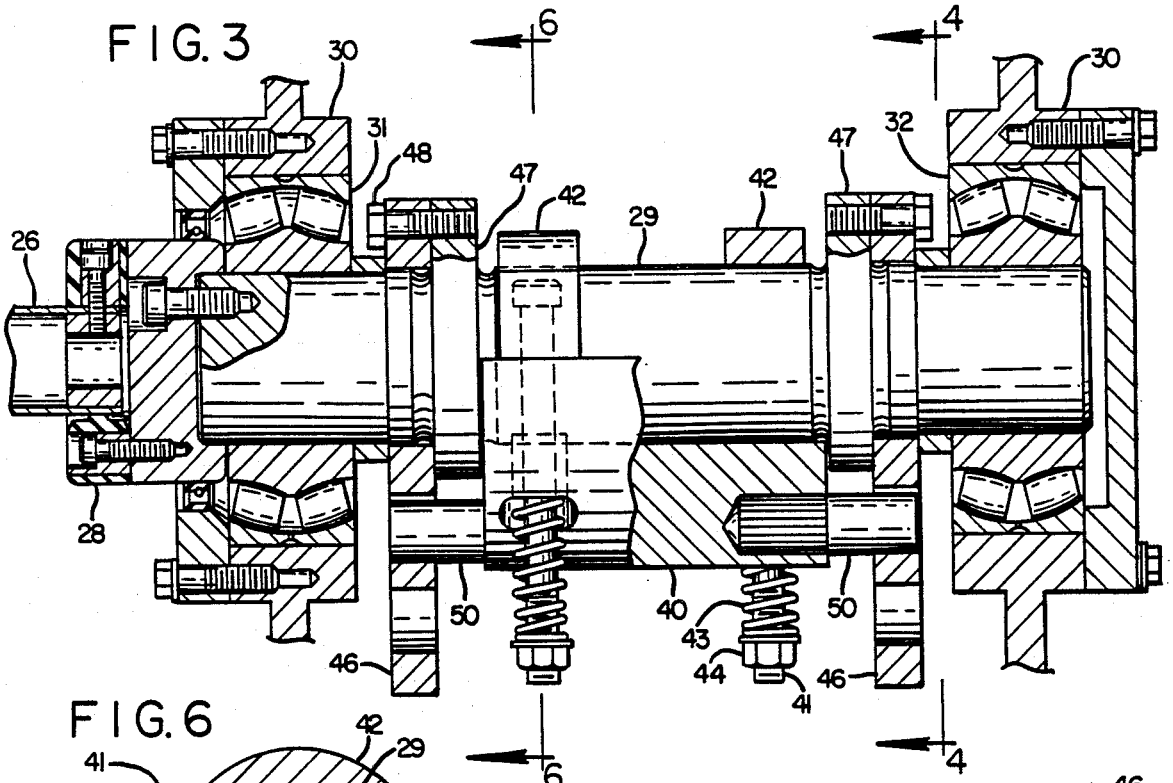
FIG. 3 is a partial sectional view of the vibration generator.
Figure 6:
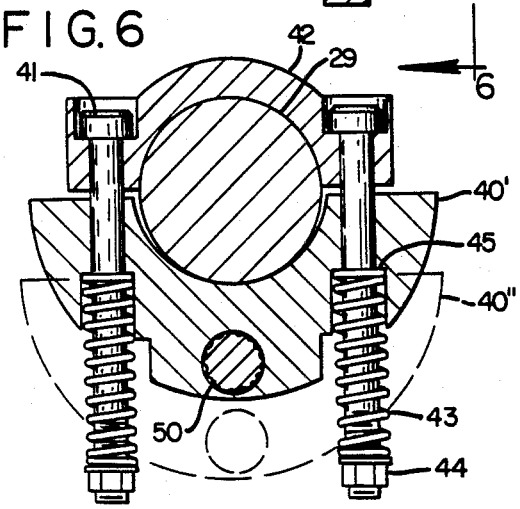
FIG. 6 is a lateral cross-sectional view, along line 6—6 of FIG. 3 illustrating the means of mounting the eccentric weight; and, FIG. 7 is a lateral sectional view, along line 4—4 of FIG. 3, illustrating an alternative construction of the latch mechanism.

The eccentric weight 40 of the variable amplitude vibration generator, having the shape of one-half of a thick shelled cylinder with an inner diameter slightly larger than the diameter of the rotor shaft 29, is secured to the rotor shaft 29 by capscrews 41 projecting through corresponding bores in the eccentric weight 40 and caps 42, as illustrated in FIGS. 3 & 6. The inner radius of the caps corresponds to that of the eccentric weight 40 permitting the weight, if otherwise unrestrained, to rotate freely on the rotor shaft 29. A compression spring 43 is trapped between a nut 44 on each capscrew 41 and a step 45 in the bores through the eccentric weight 40. The eccentric weight 40 is, therefore slidably mounted and can move radially from the centerline of the rotor shaft 29 but is urged toward the rotor shaft by the force of the compression springs 43.

Figure 4:
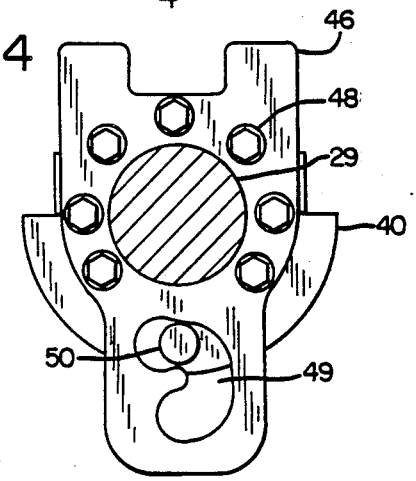
FIG. 4 is a lateral sectional view, along line 4—4 of FIG. 3, of the latch mechanism and illustrating the eccentric weight in the low amplitude position.

A latch means, responsive to the direction of rotation of the rotor shaft, releasably controls radial movement of the eccentric weight 40. As illustrated in FIGS. 3 & 4, latch plates 46 are bolted to shoulders 47 on the rotor shaft 29 by capscrews 48. Each latch plate 46 has portions defining a slot 49 of the general shape of the letter C, having a first and second end of the slot roughly tangential to the rotor shaft 29, said first and second ends being connected by an arc. A pin 50, rigidly affixed to the eccentric weight 40 and projecting from the ends thereof, engages the slot 49 in each latch plate 46.

Figure 7:
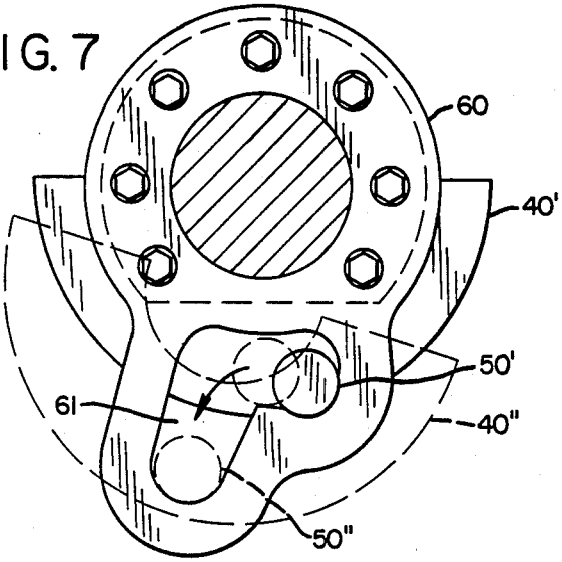

An alternative construction of the latch plates is illustrated in FIG. 7. In this construction the latch plate 60 has portions defining a slot 61 of the general shape of the letter L, with a first portion arranged tangential to the rotor shaft 29 and a second portion projecting radially away from the centerline of the rotor shaft.

The operation of the vibration generator is the same for both means of construction but the former is preferred as noise, produced by movement of the pin in the slot, is reduced.

MODE OF OPERATION

In FIG. 4 the vibration generator is shown in the stopped condition. The eccentric weight 40 is urged, into close proximity to the rotor shaft 29, into the low amplitude position 40′, by the force of the compression springs 43. The pin 50 is at rest in that portion of the slot 49 in the latch plate 46 which is closest to the centerline of the rotor shaft 29.

If the operator should select low amplitude operation, control valving, not shown, will direct pressurized fluid to the vibrator drive motor to cause the drive shaft of the vibrator drive motor 25 to rotate the rotor shaft 29 in the counterclockwise direction, as viewed in FIG. 4. Inertia will urge the eccentric weight to remain motionless until the pin 50 reaches the extreme end of the slot 49, illustrated as pin position 50′ in FIG. 5. When the pin 50 contacts the latch plate 46 at the end of the slot the eccentric weight 40 will be caused to rotate with the rotor shaft 29. While centrifugal force, resulting from rotation, will urge the eccentric weight 40 away from the rotor shaft the pin 50 will remain trapped in the low amplitude position 50′ and restrain the eccentric weight in the low amplitude position 40′. The frequency of the vibrator can be varied throughout its complete range by varying the speed of the vibrator drive motor without effecting the selected low amplitude position of the eccentric weight.

Figure 5:
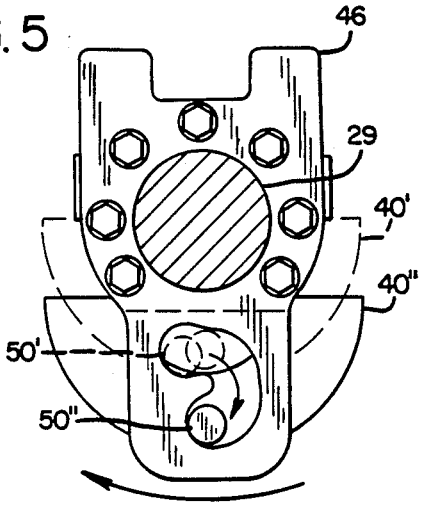
FIG. 5 is a lateral sectional view, along line 4—4 of FIG. 3, of the latch mechanism and illustrating the movement of the eccentric weight from the low to the high amplitude position.

To operate the vibration generator in the high amplitude condition, the operator, through the controls, directs the rotation of the rotor shaft in the clockwise direction as illustrated in FIG. 5. Again, the inertia of the eccentric weight will cause the weight to remain motionless initially. As rotation of the rotor shaft 29 continues the pin 50 will come in contact with the latch plate 46 at the arced portion of the slot 49 and the eccentric weight 40 will rotate with the rotation of the rotor shaft 29. As the eccentric weight is rotated, centrifugal force acting on the eccentric weight will urge the eccentric weight away from the rotor shaft, compressing the springs 43. At a rotational speed approximating the lowest usable frequency of vibration the centrifugal force will urge the pin 50 to the extreme position 50″ in the slot 49. The eccentric weight, as shown in FIG. 6, will be in its position of most remote proximity to the rotor shaft, the high amplitude position 40″. Again the operator can vary the frequency of vibration throughout its usable entire range by varying the flow of pressurized fluid to the vibrator drive motor without effecting the position of the eccentric weight.

To stop the vibration generator, the operator, through operation of the controls, slows the rotation of the vibration drive motor. As the rotational speed of the rotor shaft 29 slows the centrifugal force acting on the eccentric weight 40 will reduce. At approximately the lowest usable vibration frequency, the force exerted on the eccentric weight by the compression springs 43 will be greater than the centrifugal force acting on the eccentric weight and the eccentric weight will be urged toward the low amplitude position 40'. The pin 50 will move down the inner curve of the arced portion of the slot 49 toward the low amplitude position, as illustrated in FIG. 4. Since the power necessary to rotate the rotor varies directly with the eccentricity of the rotor, the power necessary to start and stop the rotor will be minimized by the movement of the eccentric weight to the low amplitude position. Likewise, the potential for damage to the compacted surface due to continued high amplitude vibration when the machine has stopped moving will be minimized by the automatic return of the eccentric weight to the low amplitude position 40'.

Although a specific embodiment of the invention has been shown and described, various changes and alterations might be made without departing from the spirit and broader aspects of the invention as set forth in the claims.

We claim:

1. In a compaction machine having a drum in contact with a surface to be compacted, a dual amplitude vibration generator comprising:

(a) a rotor shaft arranged for rotation in a drum;

(b) an eccentric weight rotatable with and restrained to the rotor shaft but movable radially, under the influence of centrifugal force, from a low amplitude position in close proximity to the rotor shaft to a high amplitude position in remote proximity to the rotor shaft; and (c) a latch means, responsive to the direction of rotation of the rotor shaft to restrain the eccentric weight in the low amplitude position when the rotor shaft is rotated in a first direction and to release the eccentric weight for radial movement when the rotor shaft is rotated in a direction opposite to the first direction.

2. The dual amplitude vibration generator of claim 1 wherein the latch means comprises:

(a) a means, responsive to the direction of rotation of the rotor shaft, for releasably connecting the rotor shaft and the eccentric weight.

3. The dual amplitude vibration generator of claim 1 wherein the latch means comprises:

(a) a latch plate affixed to and projecting radially from the rotor shaft, said latch plate having a slot having a first elongated aperture portion arranged tangential to the rotor shaft and a second elongated aperture portion extending from an end of the first elongated aperture portion radially outward from the rotor shaft; and (b) means attached to the eccentric weight to engage the latch plate at the first elongated aperture portion of the slot upon rotation of the rotor shaft in a first direction and to engage the latch plate at the second aperture portion of the slot upon rotation of the rotor shaft in a direction opposite that of the first direction.

4. The dual amplitude vibration generator of claims 1, 2, or 3 further comprising a means to return the eccentric weight to the low amplitude position upon reduction of the speed of rotation of the rotor shaft.

5. The dual amplitude vibration generator of claim 4 in which the means to return the eccentric weight to the low amplitude position upon reduction of the speed of rotation of the rotor shaft is a spring means acting on the eccentric weight.

6. In a compaction machine having a drum in contact with a surface to be compacted, a dual amplitude vibration generator comprising:

(a) a rotor shaft arranged for rotation in a drum;

(b) an eccentric weight restrained to the rotor shaft by;

(c) a restraining means permitting the eccentric weight to rotate independently of the rotor shaft and to be displaced radially from a low amplitude position in close proximity to the rotor shaft to a high amplitude position in remote proximity to the rotor shaft under the influence of centrifugal force and against the force of;

(d) a spring means urging the eccentric weight to the low amplitude position; and (e) a means to cause rotation of the eccentric weight with the rotor shaft and, responsive to the direction of rotation of the rotor shaft, to releasably restrain the radial movement of the eccentric weight.

7. The invention of claim 6 wherein the means to cause rotation of the eccentric weight with the rotor shaft and, responsive to the direction of rotation of the rotor shaft, to releasably restrain the the radial movement of the eccentric weight comprises:

(a) a latch plate affixed to and projecting radially from the rotor shaft, the latch plate having a slot of the general shape of the letter C having a first end aperture and a second end aperture arranged generally tangential to the rotor shaft, said first and second end apertures being connected by an arced aperture portion; and, (b) a pin rigidly affixed to and projecting from the eccentric weight and which engages the latch plate at the slot.

8. The invention of claim 6 wherein the means to cause rotation of the eccentric weight with the rotor shaft and, responsive to the direction of rotation of the rotor shaft, for releasably restraining the the radial movement of the eccentric weight comprises:

(a) a latch plate affixed to and projecting radially from the rotor shaft, the latch plate having a slot of the general shape of the letter L having a first elongated aperture arranged tangential to the rotor shaft and a second elongated aperture extending from an end of the first aperture radially outward from the rotor shaft; and, (b) a pin rigidly affixed to and projecting from the eccentric weight and which engages the latch plate at the slot.

9. In a compaction machine having a drum in contact with a surface to be compacted, a dual amplitude vibration generator comprising:

(a) a rotor shaft arranged for rotation in a drum;

(b) a latch plate affixed to and projecting radially from the rotor shaft and having portions defining a slot of the general shape of the letter C having a first end aperature and a second end aperture arranged generally tangential to the rotor shaft, said first and second ends apertures being connected by an arced aperture portion;

(c) an eccentric weight restrained to the rotor shaft by;

(d) a cap means in engagement with the rotor shaft and slidably connected to the eccentric weight to permit the eccentric weight to move radially, under the influence of centrifugal force, from a low amplitude positon in close proximity to the rotor shaft to a high amplitude position in remote proximity to the rotor shaft;

(e) a pin affixed to and projecting from the eccentric weight to engage the latch plate at the slot; and (f) a spring means acting on the cap means and the eccentric weight to urge the eccentric weight toward the low amplitude position upon slowing of the speed of rotation of the rotor shaft.

10. In a compaction machine having a drum in contact with a surface to be compacted, a dual amplitude vibration generator comprising:

(a) a rotor shaft arranged for rotation in a drum;

(b) a latch plate affixed to and projecting radially from the rotor shaft and having portions defining a slot of the general shape of the letter L having a first elongated aperture portion arranged tangential to the rotor shaft and a second elongated aperture portion extending from an end of the first elongated aperture portion radially outward from the rotor shaft;

(c) an eccentric weight restrained to the rotor shaft by;

(d) a cap means in engagement with the rotor shaft and slidably connected to the eccentric weight to permit the eccentric weight to move radially under the influence of centrifugal force from a low amplitude position in close proximity to the rotor shaft to a high amplitude position in remote proximity to the rotor shaft;

(e) a pin affixed to and projecting from the eccentric weight to engage the latch plate at the slot; and (f) a spring means acting against the cap means and the eccentric weight to urge the eccentric weight toward the low amplitude position upon slowing of the speed of rotation of the rotor shaft.

* * * * *